US005571044A

United States Patent [19]

Bolandi et al.

[11] Patent Number: 5,571,044

[45] Date of Patent: Nov. 5, 1996

[54] WAFER HOLDER FOR SEMICONDUCTOR WAFER POLISHING MACHINE

[75] Inventors: Hooman Bolandi, Santa Clara; David E. Weldon, Los Gatos, both of Calif.

[73] Assignee: Ontrak Systems, Inc., Milpitas, Calif.

[21] Appl. No.: 321,086

[22] Filed: Oct. 11, 1994

[51] Int. Cl.[6] ..... B24B 7/22

[52] U.S. Cl. ..... 451/385; 451/398

[58] Field of Search ..... 451/385, 290, 451/289, 288, 287, 285, 384, 388, 398, 402

[56] References Cited

U.S. PATENT DOCUMENTS

| | | | |
|---|---|---|---|
| 2,383,131 | 8/1945 | Kirsch | 451/385 |
| 2,573,668 | 10/1951 | Long et al. | 451/384 |
| 3,654,739 | 4/1972 | Stoy et al. . | |
| 4,627,169 | 12/1986 | Zafred . | |
| 4,811,522 | 3/1989 | Gill, Jr. . | |
| 5,193,316 | 3/1993 | Olmstead . | |
| 5,205,082 | 4/1993 | Shendon et al. . | |
| 5,212,910 | 5/1993 | Breivogel . | |
| 5,287,663 | 2/1994 | Pierce et al. . | |
| 5,297,361 | 3/1994 | Baldy et al. . | |
| 5,329,732 | 7/1994 | Karlsrud et al. . | |
| 5,329,734 | 7/1994 | Yu . | |
| 5,335,453 | 8/1994 | Baldy et al. . | |

FOREIGN PATENT DOCUMENTS

| | | |
|---|---|---|
| 0284343A3 | 9/1988 | European Pat. Off. . |
| 0362811A3 | 4/1990 | European Pat. Off. . |
| 0589433A1 | 3/1994 | European Pat. Off. . |

OTHER PUBLICATIONS

"A New Pad and Equipment Development for ILD Planarization" by Toshiyasu Beppu, Motoyuki Obara and Yausuo Minamikawa, Semiconductor World, Jan., 1994, MY Mar. 17, 1994.

"Application of Chemical Mechanical Polishing to the Fabrication of VLSI Circuit Interconnections", William J. Patrick, William L. Guthrie, Charles L. Stadley and Paul M. Schiable, J. Electrochem. Soc., vol. 138, No. 6, Jun. 1991, pp. 1778–1784.

"Theory & Practice of Lubrication for Engineers", Dudley Fuller, Wiley–Interscience, 1st ed., pp. 22–25 and 86.

Practical Ideas, Jun. 1994, p. 67.

*Primary Examiner*—Robert A. Rose

*Attorney, Agent, or Firm*—Brinks Hofer Gilson & Lione

[57] ABSTRACT

A semi-conductor wafer polishing machine having at least one polishing pad assembly and at least one wafer holder positioned to hold a semi-conductor wafer against the polishing pad assembly includes a joint having two axes of rotation intersecting at a center of rotation. A wafer chuck is supported on the joint adjacent the periphery of the chuck to provide higher material removal rates at the center of the wafer than the periphery of the wafer during polishing.

19 Claims, 5 Drawing Sheets

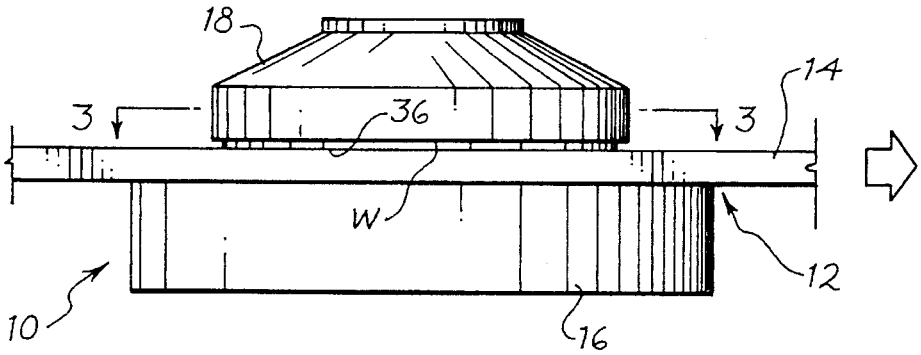
Fig. 1
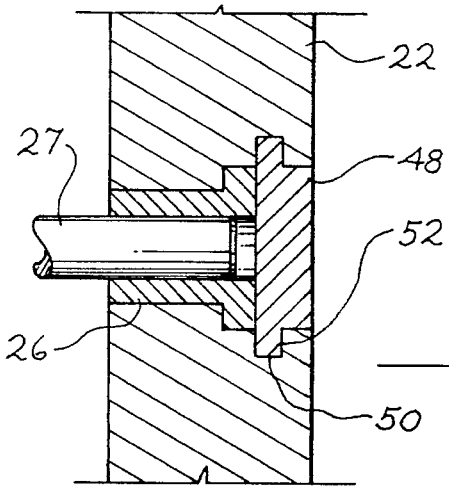
Fig. 5
Fig. 6
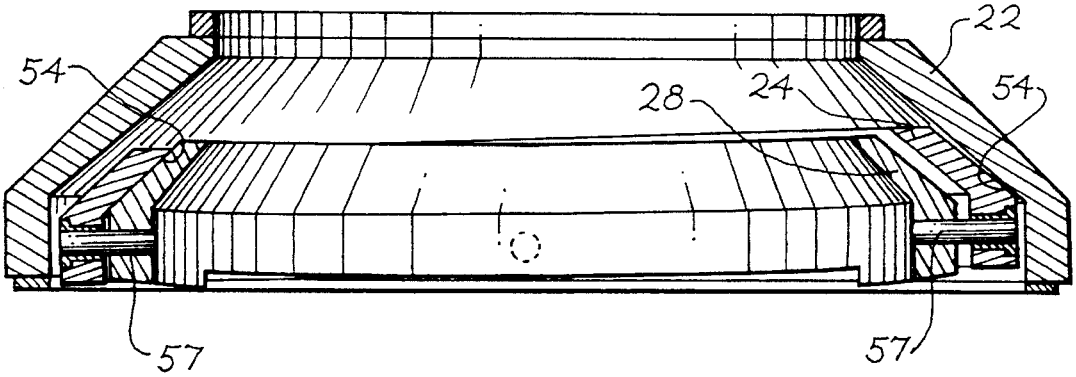

60
22
26
30
34
62
18
54
24
27
20
31
54
64
28
32
56
33
42
40
38
44

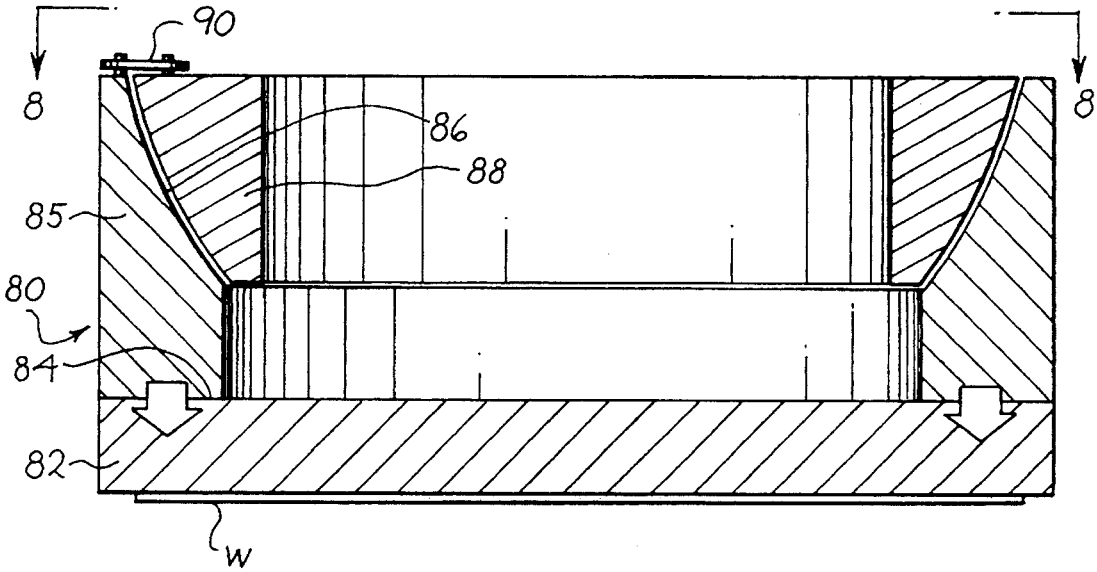
Fig. 7
Fig. 9
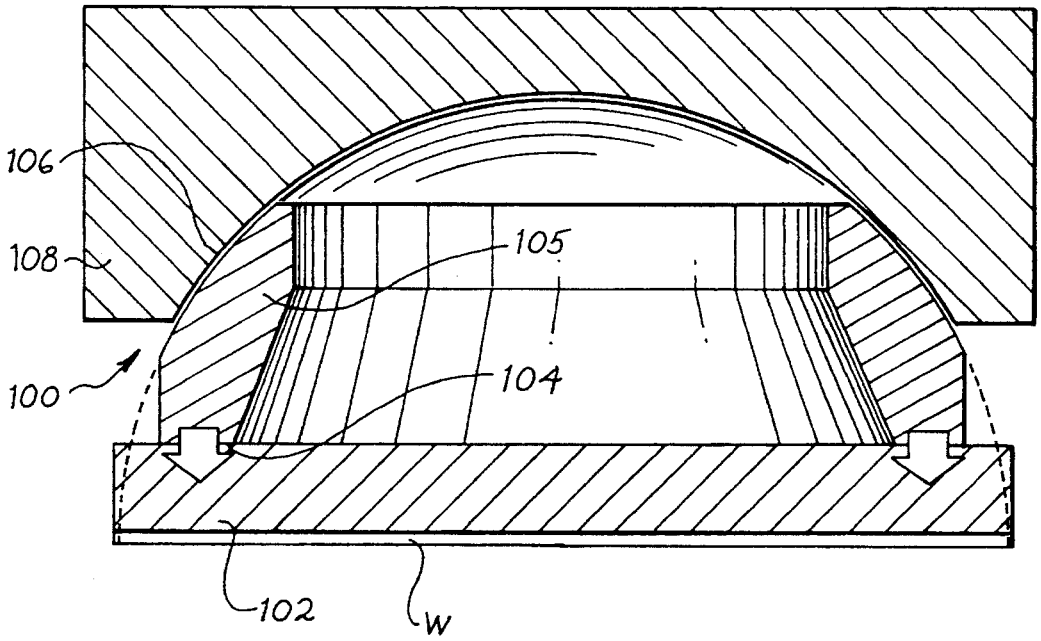

WAFER HOLDER FOR SEMICONDUCTOR WAFER POLISHING MACHINE

This invention relates to chemical mechanical wafer polishing machines of the type used to planarize semiconductor wafers, and in particular to an improved wafer holder for supporting a wafer in such a polishing machine.

Baldy U.S. Pat. No. 5,297,361 discloses a wafer polishing machine with a sample holding table that includes a cardan joint. The wafer being polished is supported on an inner ring that is mounted for rotation about a first rotational axis on an outer ring. The outer ring is in turn mounted for rotation with respect to a support about a second rotational axis. The first and second rotational axes are perpendicular, and they intersect at the center of the sample face to be polished.

Baldy addresses the problem that conventional wafer holders often tend to remove material from the periphery of the wafer at a faster rate than the center of the wafer. This can be a serious problem, which is only exacerbated by rotation of the wafer holder, which also tends to remove material at a faster rate from the periphery of the wafer. The wafer holder of Baldy includes elements of the cardan joint that project beyond the polishing plane of the wafer. This arrangement provides significant disadvantages, particularly in systems having a polishing pad which is larger in area than the wafer being polished.

SUMMARY OF THE INVENTION

This invention relates to an improvement in a semiconductor wafer polishing machine of the type comprising at least one polishing pad assembly and at least one wafer holder positioned to hold a semi-conductor wafer against the polishing pad assembly. The wafer holder comprises a wafer chuck and a chuck support element. The wafer chuck is configured to support the wafer and comprises a center and a periphery. The wafer chuck is coupled to the chuck support at a coupling region located closer to the periphery than to the center such that forces applied to the chuck by the chuck support element stress a peripheral portion of the chuck to a greater extent than a central portion of the chuck.

BRIEF DESCRIPTION OF THE DRAWINGS

FIG. 1 is a schematic view of major components of a chemical mechanical semi-conductor wafer polishing machine that incorporates a presently preferred embodiment of this invention.

FIG. 5 is an enlarged fragmentary sectional view of a portion of the wafer holder of FIG. 2.

FIG. 6 is a view corresponding to that of FIG. 3 showing the wafer holder tilted to a maximum extent.

FIG. 7 is a cross-sectional view of a second wafer holder suitable for use in the polishing machine of FIG. 1.

FIG. 9 is a cross-sectional view of a third wafer holder suitable for use in the polishing machine of FIG. 1.

DETAILED DESCRIPTION OF THE PRESENTLY PREFERRED EMBODIMENTS

Figure 2:
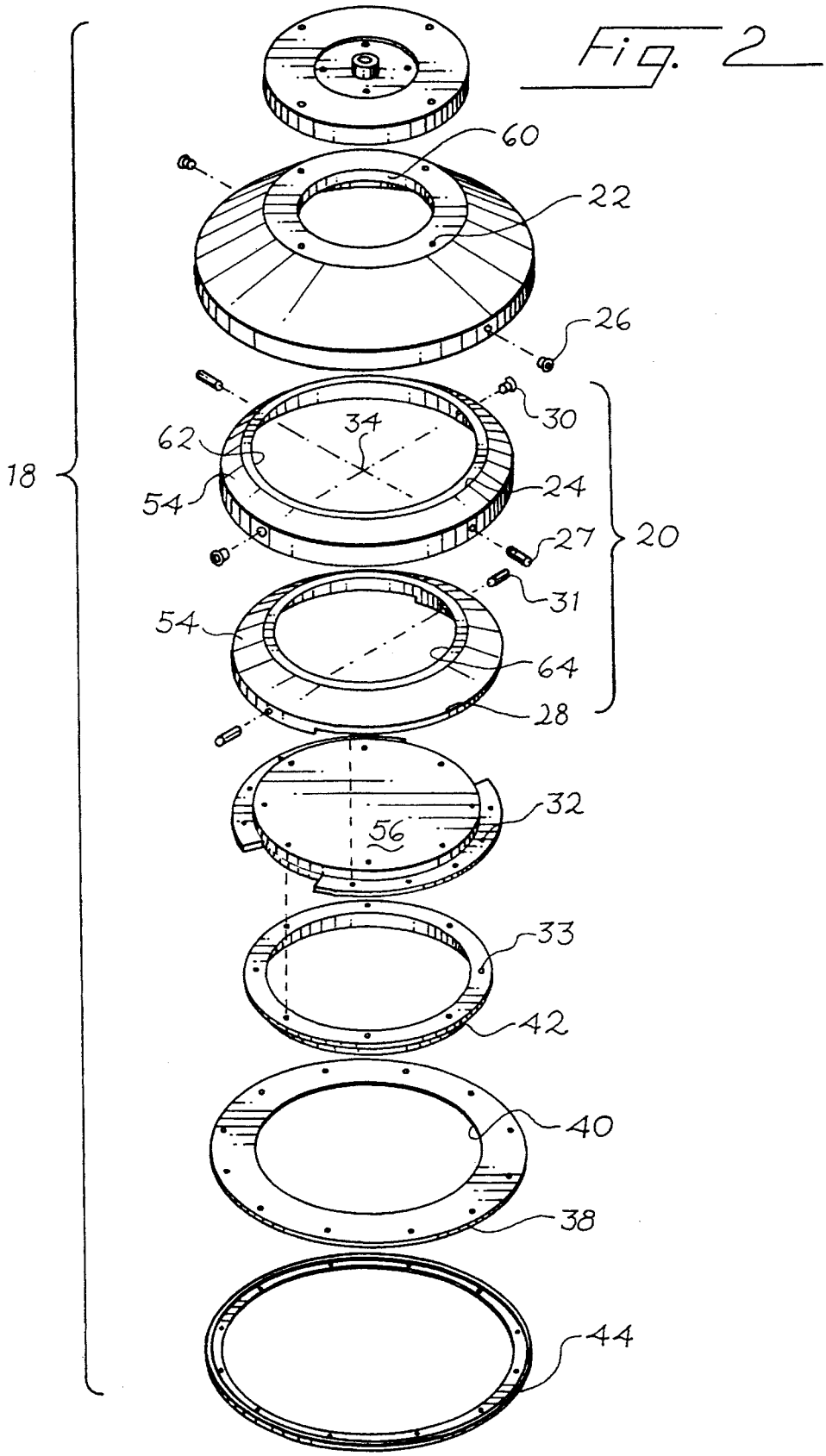
FIG. 2 is an exploded view of the wafer holder of FIG. 1.
Figure 3:
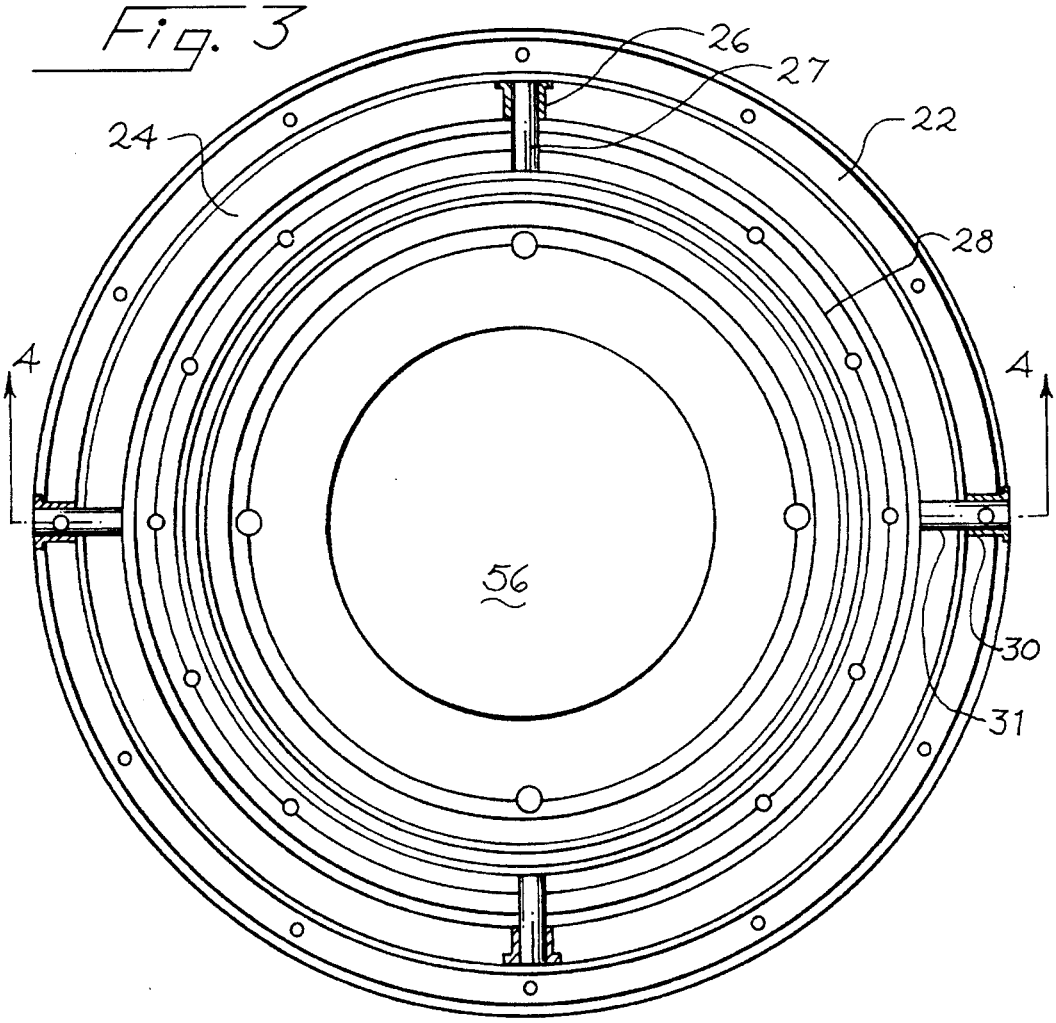
FIG. 3 is a cross-sectional view taken along line 3—3 of FIG. 1.

Turning now to the drawings, FIG. 1 is a schematic view of a polishing machine 10 that incorporates a presently preferred embodiment of this invention. This polishing machine 10 includes a polishing pad assembly 12 including a polishing pad belt 14 and a belt platen 16. A wafer holder 18 holds a semi-conductor wafer W to be polished, with a polished surface of the wafer W positioned against the polishing pad belt 14.

U.S. patent application Ser. No. 08/287,658 filed Aug. 9, 1994, assigned to the assignee of the present invention, provides details of construction for one suitable polishing machine 10. This patent application is hereby incorporated by reference in its entirety.

Turning now to FIG. 2, the wafer holder 18 includes a cardan joint 20 supported in an outer housing 22. The cardan joint 20 includes an outer ring 24 that is mounted for rotation with respect to the housing 22 by two first bearings 26 and first shafts 27 that are aligned with the X axis in this embodiment. An inner ring 28 is mounted for rotation with respect to the outer ring 24 by two second bearings 30 and second shafts 31 that are aligned with the Y axis in this embodiment. The X and Y axes meet at a central position in the wafer holder 18 and define a center of rotation 34. A wafer chuck 32 is supported only around its periphery by the inner ring 28. This area of support extends away from the perimeter of the chuck 32 by no more than about 10% of the diameter of the chuck 32. The wafer chuck 32 can be formed in any suitable manner so as to hold the wafer W in place on the chuck 32 during polishing. In some cases, the wafer chuck 32 may include vacuum hold-down devices to secure the wafer W on the wafer chuck 32, though such hold-down devices are not always required. The exposed surface of the wafer W that is positioned adjacent the polishing pad belt 14 defines a polishing plane 36 (FIG. 1).

As best shown in FIG. 2, the cardan joint 20 is provided with an annular elastomeric seal 38. The inner periphery 40 of the seal 38 fits within a peripheral groove 42 of the guide ring 33 and is retained therein. The outer periphery of the seal 38 is releasably secured to the housing 22 by a clamp ring 44 that is held in place, for example by nylon screws. The seal 38 prevents the slurry used in the chemical mechanical polishing operation from entering the interior of the cardan joint 20. The seal 38 has sufficient flexibility to allow the outer and inner rings 24, 28 to rotate as described below.

Additionally, as best shown in FIG. 5 the first bearings 26 are sealed against the slurry by elastomeric disks 48. Each of the elastomeric disks 48 defines an annular flange 50 which fits within a mating recess 52 in the housing 22. The disks 48 seal the first bearings 26 against contamination by the polishing slurry.

Figure 4:
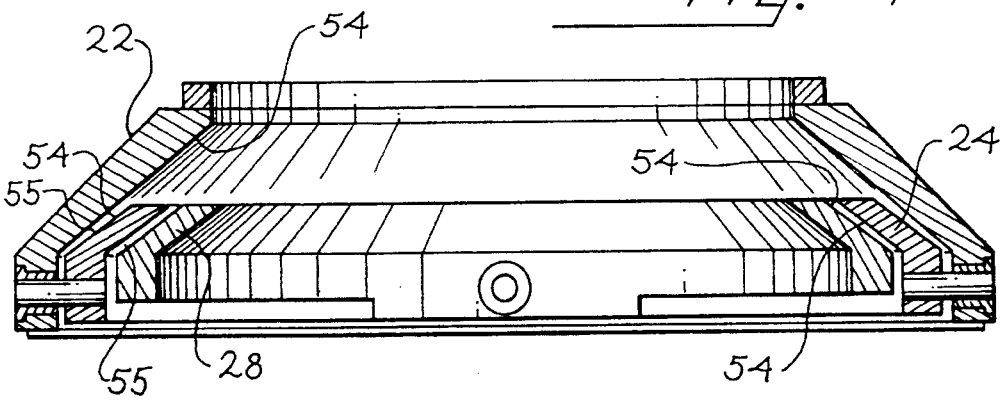
FIG. 4 is a cross-sectional view taken along line 4—4 of FIG. 3.

As best shown in FIGS. 2 and 4, the interior of the housing 22, the inner and outer surfaces of the outer ring 24, and the outer surface of the inner ring 28 form nested frusto-conical surfaces 54 that act as stops to define the maximum permitted angle of rotation about the X and Y axes. FIG. 4 shows the outer and inner rings 24, 28 in a centered position with respect to the housing 22. In this position there are gaps 55 between adjacent ones of the frusto-conical surfaces 54. FIG. 6 shows the same elements with the outer and inner rings 24, 28 tilted to a maximum extent with respect to the housing 22. Note that the nested frusto-conical surfaces 54 are now in surface contact in the regions 57, and that they limit further rotation of the outer and inner rings 24, 28 with respect to the housing 22. In this embodiment the frusto-conical surfaces are arranged to allow a maximum tilting of the outer ring 24 with respect to the housing 22 of ±1.2°, and a maximum tilt angle of the inner ring 28 with respect to the outer ring 24 of ±1.2°. The frusto-conical surfaces described above provide large-area contact between adjacent surfaces, thereby reducing stresses and strains on the outer and inner rings 24, 28.

Though the preferred embodiment provides stops that limit rotation to no more than ±1.2°, it is anticipated that in alternate embodiments rotations of ±2° or more can be allowed.

Additionally, the inner ring 28 supports the wafer chuck 32 about its peripheral surface. This even support for the wafer chuck 32 reduces distortion of the wafer chuck 32 during the polishing operation, and it stresses a peripheral portion of the chuck 32 to a greater extent than a central portion.

As best shown in FIG. 2, the wafer chuck 32 defines a rear surface 56, opposite the wafer. The housing defines a central opening 60 and the outer and inner rings 24, 28 define respective central openings 62 and 64. The central openings 60, 62, 64 allow unobstructed access to the rear surface 56 of the wafer chuck 32. This arrangement allows convenient mounting and servicing of systems such as vacuum hold down systems for the wafer W.

In spite of the fact that the offset between the center of rotation 34 and the polishing plane 36 in this embodiment amounts to about ¾ inch, the system described above has been found to provide excellent planarization of a wafer W, with little or no tendency to remove material at a higher rate from the periphery of the wafer W than the center. Furthermore, the stops formed by the frusto-conical surfaces 54 maintain the cardan joint 20 in a substantially centered relationship, even when the wafer W is not in contact with the belt 14.

The cardan joint 20 gimbles to allow the polishing plane 36 of the wafer W to orient itself parallel to the polishing pad, whether on a belt or a rotating table. The cardan joint allows for near-perfect alignment between these two surfaces. The shape of the housing, inner ring, and outer ring and the mounting of the chuck onto the inner ring ensure uniform pressure distribution across the periphery of the wafer. The fully sealed design protects the bearings and other components of the cardan joint from contamination by the slurry.

Figure 8:
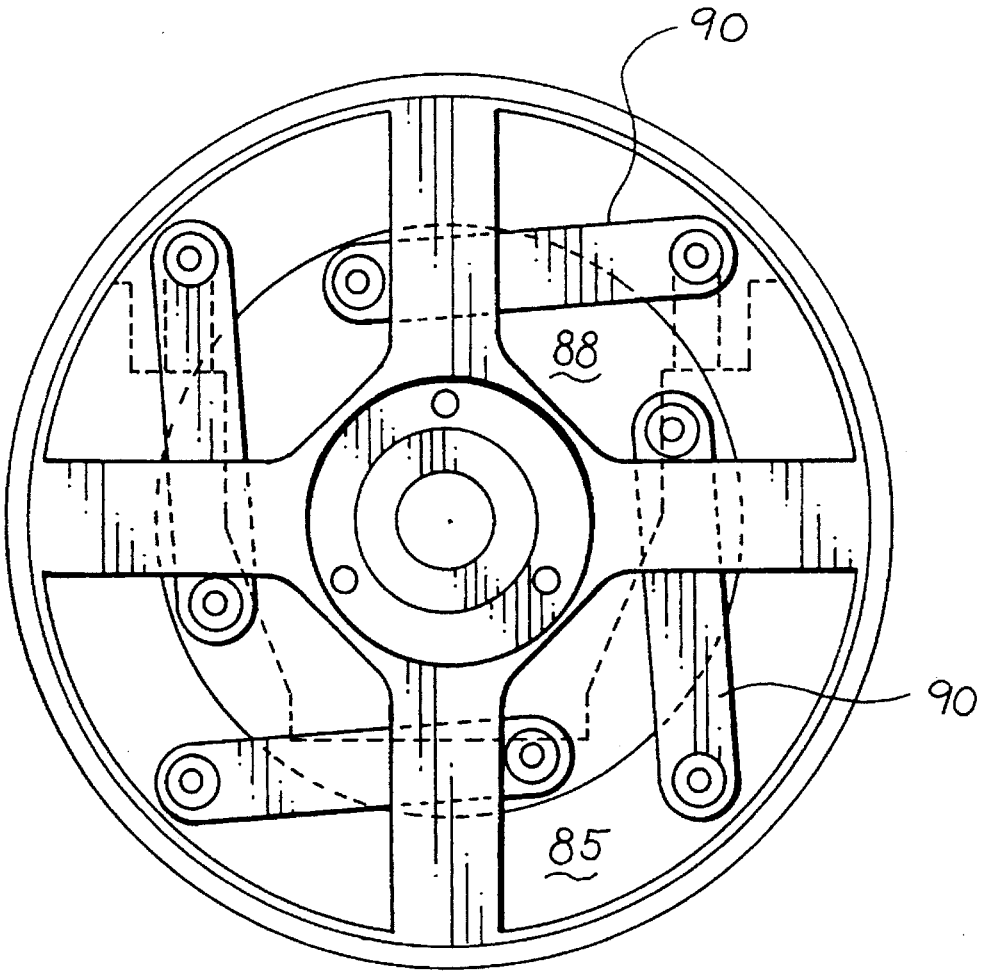
FIG. 8 is a top view along line 8—8 of FIG. 6.

FIGS. 7 and 8 relate to a second preferred wafer holder 80, which includes a wafer chuck 82 that supports a wafer W. The chuck 82 is shaped as a plate that is coupled to an annular element 85 at a coupling region 84. The annular element 85 defines a hemispherical bearing surface 86, and the annular element 85 forms a ball joint with a hemispherical support 88. The ball joint can be formed as a standard bearing, or hydrostatic bearings can be used as described in a related patent application (Attorney Docket No. 7103/4) filed on the same day as the present application and assigned to the assignee of the present invention. This application is hereby incorporated by reference in its entirety.

In this embodiment, torque is transmitted from the support 88 to the annular element 85 by copper-beryllium springs 90 (FIG. 8) to rotate the wafer W during polishing. By way of example, the chuck 82 can be formed from a stainless steel plate, approximately 1 inch in thickness and about 9.75 inches in diameter.

FIG. 9 shows another wafer holder 100, including a chuck 102 and an annular element 105 coupled together in a coupling region 104. The annular element 105 defines a hemispherical bearing surface 106. The annular element 105 and a support 108 form a ball joint. The wafer holder 100 differs from the holder 80 in that the bearing surface 106 is convex. This allows the center of rotation 110 to be positioned at the front surface of the wafer W.

In all three of the wafer holders 18, 80, 100, forces are applied to the chuck 32, 82, 102 by the annular element 28, 85, 105 at a location nearer the periphery than the center of the chuck 32, 82, 102. This arrangement has been found to produce higher material removal rates at the center of the wafer W than at the periphery, perhaps because of microscopic strains in the chuck 32, 84, 104 resulting from forces applied to the chuck 32, 82, 102 by the annular element 28, 85, 105. Higher removal rates at the center of the wafer are highly advantageous, because the holder 18, 80, 100 can be rotated at a rate selected to increase material removal rates at the periphery as compared to the center of the wafer. By properly selecting the rotation rate for the wafer W, substantially uniform material removal rates across the wafer W can be achieved.

In the wafer holders 80, 100 the coupling region 84, 104 is separated from the periphery of the chuck 82, 102 by no more than 17% and 12% of the diameter of the chuck 82, 102, respectively. In the wafer holder 18 the coupling region is separated from the periphery by no more than 10% of the diameter of the chuck 32. Actual tests have confirmed the foregoing for the wafer holder 18, and similar results are expected for the wafer holders 80, 100.

Of course, it should be understood that a wide range of changes and modifications can be made to the preferred embodiment described above. For example, the wafer holder of this invention can readily be used with rotating polishing pads in addition to the belt-type polishing pads discussed above. Bearings including ball bearings or roller bearings can be substituted for the bushings shown, and the stops can be formed by a variety of shoulders and other shapes on the moving parts. It is not essential in all embodiments that a cardan joint or a ball joint be included in the wafer holder. If desired, a rigidly mounted wafer support element can apply forces to the wafer chuck directly, as long as forces are applied to the wafer chuck in a coupling region nearer the periphery than the center of the wafer chuck. It is not essential that the coupling region be annular in shape, and three or more discrete points or regions of contact can make up the coupling region.

It is therefore intended that the foregoing detailed description be regarding as illustrative rather than limiting, and that it be understood that it is the following claims, including all equivalents, that are intended to define the scope of this invention.

We claim:

1. In a semiconductor wafer polishing machine of the type comprising at least one polishing pad assembly and at least one wafer holder positioned to hold a semiconductor wafer against the polishing pad assembly, said wafer holder comprising a joint having at least two axes of rotation intersecting at a center of rotation, said wafer comprising a surface to be polished that defines a polishing plane, the improvement comprising:

a wafer chuck comprising a front surface and a back surface, said front surface configured to support the wafer, said back surface comprising a periphery and a central region disposed inwardly of the periphery, said chuck coupled to the joint at a coupling region located on the back surface closer to the periphery than to the central region such that forces applied to the chuck by the joint stress a peripheral portion of the chuck to a greater extent than a central portion of the chuck.

2. The invention of claim 1 wherein the joint comprises a cardan joint comprising a housing, an outer ring rotatably mounted on the housing by two first bearings aligned with a first axis of rotation, an inner ring rotatably mounted on the outer ring by two second bearings aligned with a second axis of rotation, and wherein the wafer chuck is mounted at its periphery to the inner ring.

3. In a semiconductor wafer polishing machine of the type comprising at least one polishing pad assembly and at least one wafer holder positioned to hold a semiconductor wafer against the polishing pad assembly, said wafer holder comprising a joint having at least two axes of rotation intersecting at a center of rotation, said wafer comprising a surface to be polished that defines a polishing plane, the improvement comprising:

a wafer chuck configured to support the wafer, said chuck comprising a periphery and a central region disposed inwardly of the periphery, said chuck coupled to the joint at a coupling region located closer to the periphery than to the central region such that forces applied to the chuck by the joint stress a peripheral portion of the chuck to a greater extent than a central portion of the chuck;

wherein the joint comprises a cardan joint comprising a housing, an outer ring rotatably mounted on the housing by two first bearings aligned with a first axis of rotation, an inner ring rotatably mounted on the outer ring by two second bearings aligned with a second axis of rotation, and wherein the wafer chuck is mounted at its periphery to the inner ring;

further comprising an annular seal comprising an outer periphery secured to the housing and an inner periphery secured to one of the inner ring and the chuck.

4. The improvement of claim 3 wherein the chuck comprises a peripheral groove that receives the inner periphery of the annular seal.

5. The improvement of claim 3 further comprising at least two bearing seals, each mounted to the outer ring to seal the respective bearing.

6. The improvement of claim 5 wherein each bearing seal comprises an elastomeric disc retained by the outer ring outside of and adjacent to the respective bearing.

7. The improvement of claim 1 wherein the center of rotation is positioned on the opposite side of the polishing plane from the polishing pad assembly by an offset distance.

8. In a semiconductor wafer polishing machine of the type comprising at least one polishing pad assembly and at least one wafer holder positioned to hold a semiconductor wafer against the polishing pad assembly, said wafer holder comprising a joint having at least two axes of rotation intersecting at a center of rotation, said wafer comprising a surface to be polished that defines a polishing plane, the improvement comprising:

a wafer chuck configured to support the wafer, said chuck comprising a periphery and a central region disposed inwardly of the periphery, said chuck coupled to the joint at a coupling region located closer to the periphery than to the central region such that forces applied to the chuck by the joint stress a peripheral portion of the chuck to a greater extent than a central portion of the chuck;

wherein the center of rotation is positioned on the opposite side of the polishing plane from the polishing pad assembly by an offset distance;

wherein the offset distance is about ¾ inch.

9. In a semiconductor wafer polishing machine of the type comprising at least one polishing pad assembly and at least one wafer holder positioned to hold a semiconductor wafer against the polishing pad assembly, said wafer holder comprising a joint having at least two axes of rotation intersecting at a center of rotation, said wafer comprising a surface to be polished that defines a polishing plane, the improvement comprising:

a wafer chuck configured to support the wafer, said chuck comprising a periphery and a central region disposed inwardly of the periphery, said chuck coupled to the joint at a coupling region located closer to the periphery than to the central region such that forces applied to the chuck by the joint stress a peripheral portion of the chuck to a greater extent than a central portion of the chuck;

wherein the joint comprises a cardan joint comprising a housing, an outer ring rotatably mounted on the housing by two first bearings aligned with a first axis of rotation, an inner ring rotatably mounted on the outer ring by two second bearings aligned with a second axis of rotation, and wherein the wafer chuck is mounted at its periphery to the inner ring;

wherein the housing, the inner ring, and the outer ring comprise respective nested frusto-conical surfaces, and wherein the frusto-conical surfaces contact one another to limit motion of the cardan joint.

10. The improvement of claim 2 wherein the wafer chuck comprises a rear surface opposite the wafer, and wherein the holder, the outer ring, and the inner ring comprise respective central openings that provide free access to the rear surface of the wafer chuck.

11. In a semiconductor wafer polishing machine of the type comprising at least one polishing pad assembly and at least one wafer holder positioned to hold a semiconductor wafer against the polishing pad assembly, said wafer holder comprising a joint having at least two axes of rotation intersecting at a center of rotation, said wafer comprising a surface to be polished that defines a polishing plane, the improvement comprising:

a wafer chuck configured to support the wafer, said chuck comprising a periphery and a central region disposed inwardly of the periphery, said chuck coupled to the joint at a coupling region located closer to the periphery than to the central region such that forces applied to the chuck by the joint stress a peripheral portion of the chuck to a greater extent than a central portion of the chuck;

wherein the chuck defines a maximum cross-sectional dimension parallel to the wafer, and wherein the coupling region is separated from the periphery by no more than 15% of the maximum cross-sectional dimension.

12. The invention of claim 11 wherein the coupling region is separated from the periphery by no more than 10% of the maximum cross-sectional dimension.

13. The invention of claim 1 wherein the joint is a ball joint.

14. In a semiconductor wafer polishing machine of the type comprising at least one polishing pad assembly and at least one wafer holder positioned to hold a semiconductor wafer against the polishing pad assembly, said wafer holder comprising a joint having at least two axes of rotation intersecting at a center of rotation, said wafer comprising a surface to be polished that defines a polishing plane, the improvement comprising:

a wafer chuck configured to support the wafer, said chuck comprising a periphery and a central region disposed inwardly of the periphery, said chuck coupled to the joint at a coupling region located closer to the periphery than to the central region such that forces applied to the chuck by the joint stress a peripheral portion of the chuck to a greater extent than a central portion of the chuck;

wherein the joint is a ball joint;

wherein the center of rotation is aligned substantially with a polished surface of the wafer.

15. In a semiconductor wafer polishing machine of the type comprising at least one polishing pad assembly and at least one wafer holder positioned to hold a semiconductor wafer against the polishing pad assembly, the improvement comprising:

a chuck-support element included in the wafer holder;

a wafer chuck included in the wafer holder and comprising a front surface and a back surface, said wafer chuck configured to support the wafer, and said back surface comprising a periphery and a central region disposed inwardly of the periphery;

said wafer chuck coupled to the chuck support element at a coupling region located on the back surface closer to the periphery than to the central region such that forces applied to the chuck by the chuck support element stress a peripheral portion of the chuck to a greater extent than a central portion of the chuck.

16. In a semiconductor wafer polishing machine of the type comprising at least one polishing pad assembly and at least one wafer holder positioned to hold a semiconductor wafer against the polishing pad assembly, the improvement comprising:

a wafer chuck and a chuck-support element included in the wafer holder;

said wafer chuck configured to support the wafer and comprising a periphery and a central region disposed inwardly of the periphery;

said wafer chuck coupled to the chuck support element at a coupling region located closer to the periphery than to the central region such that forces applied to the chuck by the chuck support element stress a peripheral portion of the chuck to a greater extent than a central portion of the chuck;

wherein the chuck defines a maximum cross-sectional dimension parallel to the wafer, and wherein the coupling region is separated from the periphery by no more than 15% of the maximum cross-sectional dimension.

17. The invention of claim 16 wherein the coupling region is separated from the periphery by no more than 10% of the maximum cross-sectional dimension.

18. The invention of claim 1 wherein the coupling region and the front surface are both intersected by an axis transverse to the polishing plane.

19. The invention of claim 15 wherein the coupling region and the front surface are both intersected by an axis transverse to the front surface.

* * * * *